US008116646B2

(12) United States Patent
Akiyama

(10) Patent No.: US 8,116,646 B2
(45) Date of Patent: Feb. 14, 2012

(54) IMAGE FORMING APPARATUS AND METHOD FOR THE SAME

(75) Inventor: Satoshi Akiyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 94 days.

(21) Appl. No.: 12/777,032

(22) Filed: May 10, 2010

(65) Prior Publication Data

US 2010/0290800 A1 Nov. 18, 2010

(30) Foreign Application Priority Data

May 12, 2009 (JP) ..... 2009-115718

(51) Int. Cl.
*G03G 15/00* (2006.01)

(52) U.S. Cl. ..... 399/49; 399/72

(58) Field of Classification Search ..... 399/38, 399/46, 49, 72, 297–302, 308
See application file for complete search history.

(56) References Cited

U.S. PATENT DOCUMENTS 6,657,649 B2 * 12/2003 Odamura et al. ..... 347/213
7,221,882 B2 * 5/2007 Nakagawa ..... 399/49
7,778,559 B2 * 8/2010 Omelchenko ..... 399/49

FOREIGN PATENT DOCUMENTS

JP 2001-194862 7/2001
JP 2004-358756 12/2004

* cited by examiner

*Primary Examiner* — Hoan Tran
(74) *Attorney, Agent, or Firm* — Fitzpatrick, Cella, Harper & Scinto

(57) ABSTRACT

To solve a problem of an increase of kinds of toner patches required for an adjustment accompanying an increase of kinds of half tones to be coped with that results from an intention of acquiring more stable image by forming the toner patches between paper sheets. It becomes possible to form more toner patches and therefore to deal with an increase of kinds of toner patches by correcting a density in a space of a line count obtained by summing up a line count corresponding to a space between paper sheets during a continuous printing operation, a rear-end blank line count of the n-th page, and a leading-end blank line count of the (n+1)th page that is enabled by comparing the size of a recording material and the size of pixel data and thereby by identifying a blank portion of the recording material.

4 Claims, 15 Drawing Sheets

| FIG.7A | FIG.7B |
|---|---|

| FIG.11A | FIG.11B |
|---|---|

START
S301
SET MAIN SCANNING PIXEL COUNT
SET VERTICAL SCANNING LINE COUNT
S302
IS PRINT COMMAND RECEIVED ?
YES
NO
S303
SET LEADING-END RIGHT BLANK LINE COUNT TO 0
S304
SET REAR-END RIGHT BLANK LINE COUNT TO 0
S305
RECEIVE AND STORE CODE DATA IN RAM 25
S306
CONVERT PIXEL DATA
S307
IS LEADING-END RIGHT BLANK LINE FIXED?
YES
NO
S308
IS LEFT SENSOR AREA DETECTED?
YES
NO

IMAGE FORMING APPARATUS AND METHOD FOR THE SAME

BACKGROUND OF THE INVENTION

1. Field of the Invention

The present invention relates to a color image forming apparatus, and more specifically to a color image forming apparatus for carrying out calibration with a toner patch.

2. Description of the Related Art

Conventionally, since densities of obtained images in a color image printing apparatus vary due to changes of temperature and humidity of its operation environments and temporal degradation of components of an image forming system, a periodical adjustment processing of image forming conditions (calibration) is executed.

Generally, in the case of the color image forming apparatus of the electrophotography system, a toner patch for density detection is formed on an intermediate transfer body, the drum, or others with toner of each color, and the density of the toner patch is detected with the density detection sensor for the toner of each color so that a constant gray scale-density characteristic may be acquired. The image forming apparatus is configured so that a stable image may be obtained by executing a density control whereby a density detection result of the toner patch is fed back to process conditions, such as an exposure quantity and a development bias, and the conditions are altered.

When carrying out continuous printing with such an image forming apparatus, if the adjustment processing is waited until the printing is completed, a proper adjustment may not be able to be achieved. For this reason, there is proposed a technology of acquiring a more stable image by forming the toner patch for density detection between paper sheets printed successively on a photoconductor at the time of the continuous printing so that an adjustment processing may be possible even during printing (for example, refer to Japanese Patent Laid-Open No. 2001-199862). Moreover, there is proposed a configuration that enables a half tone processing for each object to be performed even for an image input for which a definition of the half tone processing changes for every object (for example, refer to Japanese Patent Laid-Open No. 2009-358756).

However, in order to realize further higher quality of image with the technology whereby the toner patch is formed between paper sheets at the time of the continuous printing that was explained in the paragraph of BACKGROUND ART and a more stable image is obtained, a configuration of switching the half tone processing for every object is needed and consequently kinds of half tones increase. As a result, it is necessary to increase the kinds of patches required for a density adjustment, and therefore this configuration poses a problem that a space between paper sheets must be set more by that increment.

The present invention is made in view of the above-mentioned problem, and aimed at providing a capability of extending an area where the toner patch can be formed at the time of the continuous printing as much as possible, so that the necessary density adjustment is achieved without extending the space between paper sheets printed successively.

SUMMARY OF THE INVENTION

In order to attain the above-mentioned object, the image forming apparatus of the present invention has image forming means for forming an image that is indicated by image data on an intermediate transfer body, transfer means for transferring the image formed by the image forming means onto a recording material, pattern forming means for forming a pattern for calibration on the intermediate transfer body, detection means for reading the pattern for calibration formed on the intermediate transfer body, condition altering means for altering image forming conditions based on a result read by the detection means, cleaning means for removing the pattern for calibration formed on the intermediate transfer body before performing the transfer by the transfer means, and blank identifying means for identifying a blank portion by comparing an area of the recording material and an area of the image indicated by the image data in the recording material, wherein when the image forming is performed continuously over a plurality of recording materials, the pattern for calibration is formed in an area on the intermediate transfer body that corresponds to an area obtained by adding the identified blank to a space between the continuous recording material and recording material.

Further features of the present invention will become apparent from the following description of exemplary embodiments (with reference to the attached drawings).

DESCRIPTION OF THE EMBODIMENTS

First Embodiment

[System Configuration]

Best modes for carrying out the present invention will be described using drawings.

Figure 1:
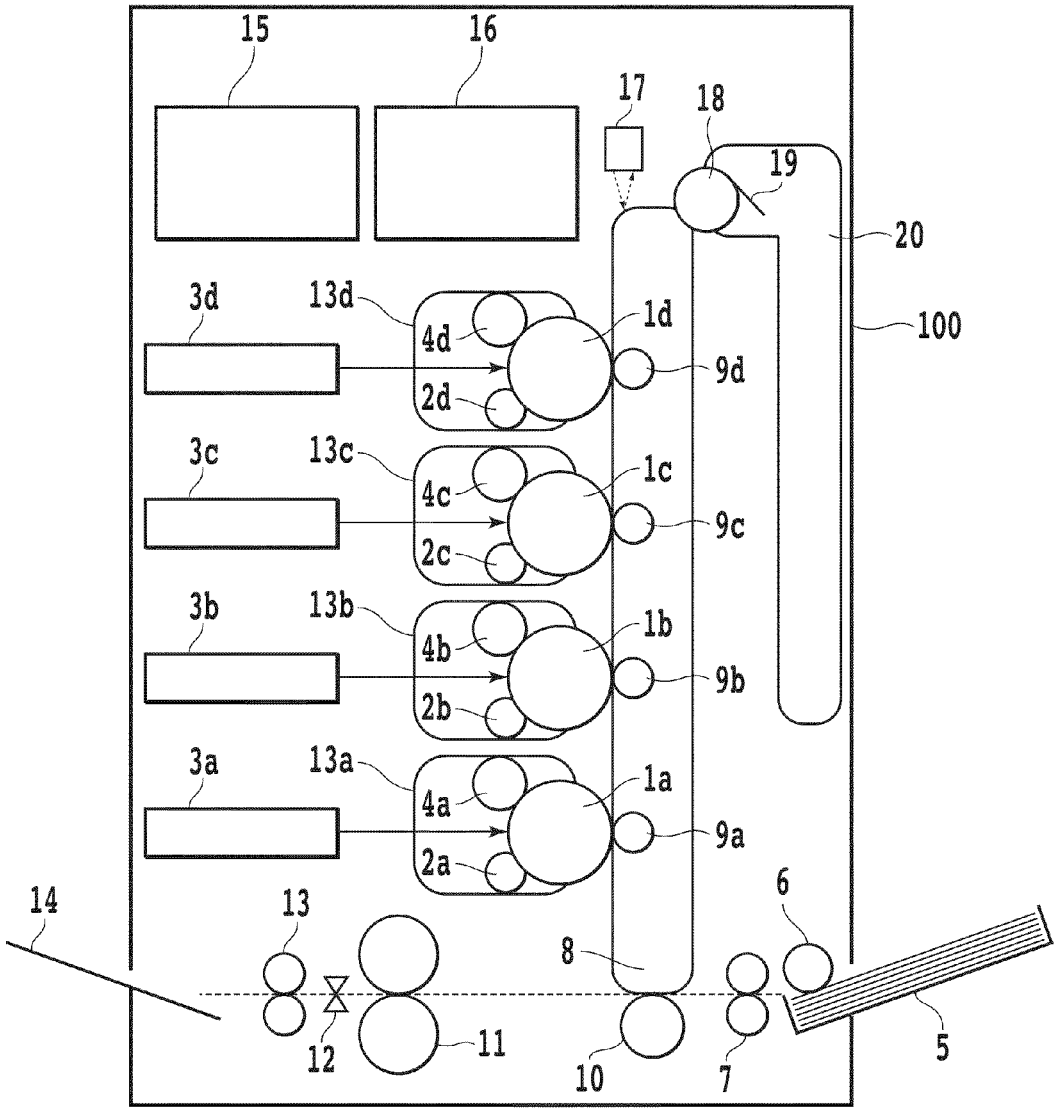
FIG. 1 is a sectional view of a color printer in a first embodiment of the present invention.

FIG. 1 is a sectional view of a color printer showing a feature of the present invention, and hereafter any element of the same function is given the same reference numeral in attached drawings of this application. Moreover, addition of a, b, c, and d after the reference numeral indicates existence of a plurality of configurations that perform the same function, for example, a configuration of performing the same functions for a plurality of colors. In this case, the configuration is specified so that a, b, c, and d show different colors, respectively, for example, black, magenta, cyan, and yellow.

Figure 2:
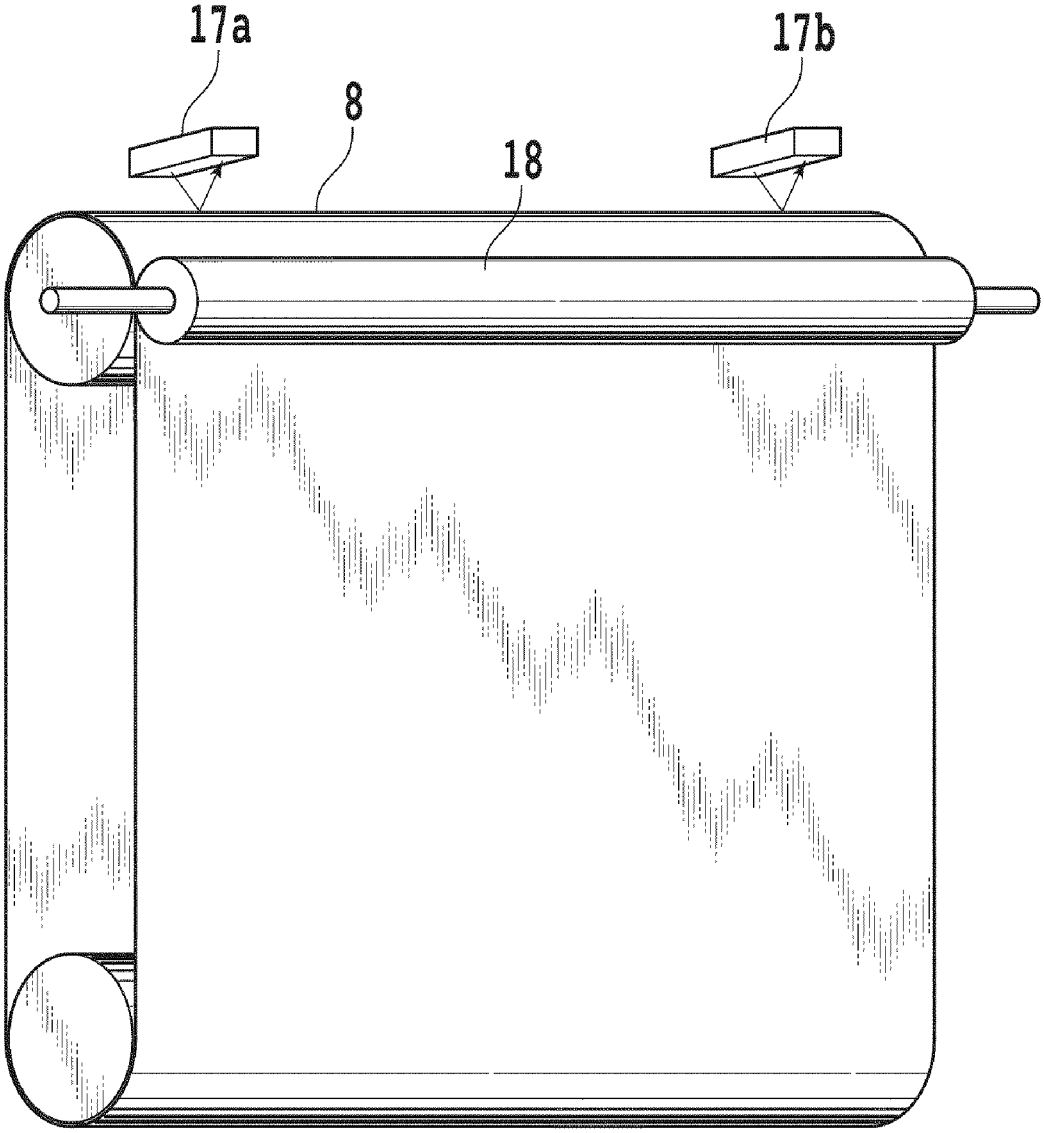
FIG. 2 is a diagram showing an arrangement configuration of the color printer in the first embodiment of the present invention.

FIG. 2 is a diagram showing an arrangement configuration including a printer body 100 of the color printer showing the feature of the present invention.

The printer body 100 is equipped with a photoconductor drum 1, an electrostatic charger 2 for uniformly charging the photoconductor drum 1, and a laser scanner 3 for forming a latent image on the photoconductor drum 1 by scanning laser light thereon being synchronized with the video data. Moreover, the printer body 100 is equipped with a developing unit 4 for visualizing the latent image on the photoconductor drum 1, a paper cassette 5 for storing paper, and a paper feed roller 6 for feeding the paper in the paper cassette 5 to the printer body 100. Furthermore, it is equipped with a resist roller 7 that temporarily halts the paper fed by the paper feed roller 6, and resumes paper conveyance being timed to the image.

A primary transfer unit 9 transfers a toner image on the photoconductor drum 1 to an intermediate transfer belt 8 that is an intermediate transfer body that transfers a color image after superposing the toner image thereon, and a secondary transfer unit 10 transfers the toner image on the intermediate transfer belt 8 onto the conveyed paper.

Moreover, the printer body 100 is equipped with a fixing unit 11 for fixing the toner image on the paper by heating and pressurization, a paper discharge sensor 12 for checking existence/absence of the paper, a paper discharge roller 13 for discharging the paper to the outside of the apparatus, and a paper discharge tray 14. Furthermore, it is equipped with a controller control section 15, an engine control section 16, and a density sensor 17 for detecting density of the toner image on the intermediate transfer belt 8.

A cleaning roller 18 removes the toner image from the intermediate transfer belt 8 by adding electric charges of the opposite polarity to the toner, a blade 19 scrapes off the toner on the cleaning roller 18, and an exhaust toner box 20 collects the toner that was scraped off by the blade 19.

Figure 3:
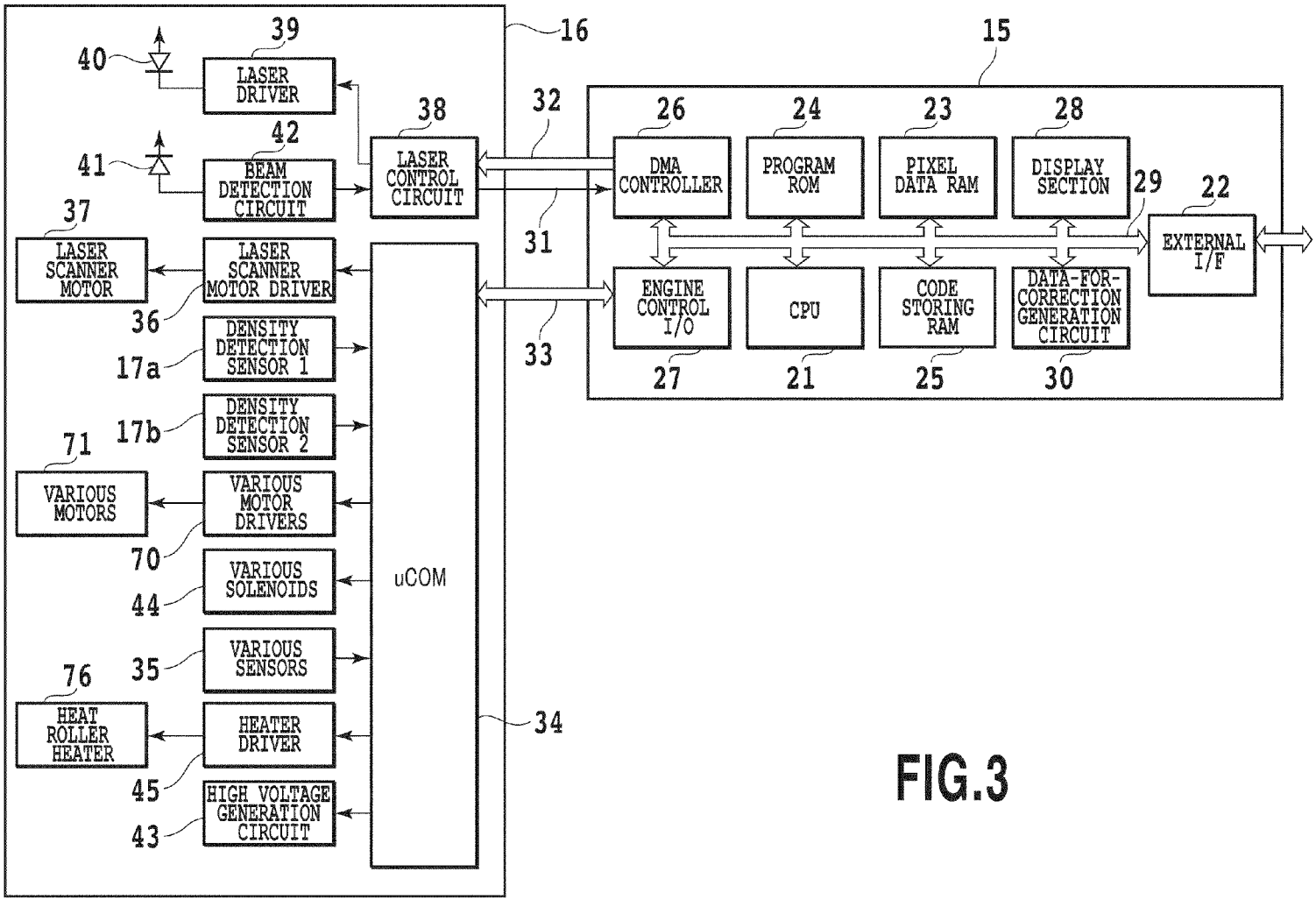
FIG. 3 is a block diagram of a control section of the color printer in the first embodiment of the present invention.

FIG. 3 is a block diagram of a control section of the color printer. In this figure, the control section of the color printer can be divided broadly into the controller control section 15 as image processing means for generating pixel data and the engine control section 16. The controller control section 15 has a role of receiving the image data coded by an external host computer etc., converting the code data into bit-mapped pixel data, and sending the pixel data to the engine control section 16.

Moreover, the engine control section 16 has a role of forming the toner image on paper as a recording material according to the pixel data received from the controller control section 15. The controller control section 15 has a CPU 21 as control means. Each of the following devices is connected to the CPU 21 through an internal bus 29. That is, they are an external I/F 22, pixel data RAM 23, program ROM 24, code storing RAM 25, a DMA controller 26, an engine control I/O 27, a data-for-correction generation circuit 30, a display section 28, etc.

The internal bus 29 consists of a data bus, an address bus, and a control bus, and enables the CPU 21 to access respective devices. The controller control section 15 such as described above receives the coded image data through an external interface (e.g., a Centronics type parallel interface or an RS232C type serial interface).

The received code data is inputted into the external I/F 22. The CPU 21 stores the code data inputted through the external I/F 22 into the RAM 25 as a transmission preparation processing of the image data, at the same time converts the code data into the pixel data according to a predetermined format, and stores the pixel data in a specific address of the RAM 23. Incidentally, in the image forming using an electrophotography process, since there are a small number of gray scales that can be expressed with a single pixel, a pseudo half tone of performing gray scale representation with a plurality of pixels (e.g., a dither method and an error diffusion method) is applied in conversion into pixel data.

The RAM 23 for storing the converted pixel data is so-called bit map memory. A program for converting the code data into the pixel data is stored in the ROM 24.

After performing conversion and storage as described above, the CPU 21 checks that the below-mentioned engine control section 16 is ready to receive the data, and then places the DMA controller 26 in an active state. The DMA controller 26 uses exclusively the internal bus 29 and reads the pixel data stored in the RAM 23 starting from a predetermined address. When the DMA controller 26 becomes active, the CPU 21 and the DMA controller 26 retain exclusive use of the internal bus 29 alternately.

The DMA controller 26 reads the pixel data from the predetermined address of the RAM 23, and converts the read data into serial data. The converted serial data is synchronized with a horizontal synchronization signal 31 received from the engine control section 16 that will be described later, and is sent as an image signal 32 to the engine control section 16. The engine control section 16 forms the toner image according to the transmitted image signal 32. Thus, the controller control section 15 converts the image signal received from the outside into the image signal that is made up of serial data (that is, being made into a raster image) and sends it to the engine control section 16.

Incidentally, the controller control section 15 makes data for correction generated in the data-for-correction generation circuit 30 into the raster image similarly, in addition to the image data received through the external interface, and sends it to the engine control section 16. The engine control section 16 forms the toner image for calibration (hereinafter referred to as a toner patch) as a pattern for calibration on the intermediate transfer belt 8 according to the transmitted data for correction. The data for correction is a plurality of gray scales arranged in a patch form so that if the toner image is formed and its density is read by the density sensor 17, a gray scale-density characteristic will be obtained. In the case where both the dither method and the error diffusion method are used in order to generate toner patch data, and in the case where a plurality of dither methods each with a varied matrix and a varied line count are used, different pieces of data for correction (image forming conditions) are prepared for the respective methods.

Since this embodiment uses the dither method of a low line count that is used for photographs etc., the dither method of a high line count that is used for characters and thin lines, and the error diffusion method that produces reduced moire generation in printed images together according to a kind of the image, it needs three kinds of data for correction. When the toner patch is formed (i.e., pattern is formed) in this way, the density of the toner patch formed on the intermediate transfer belt 8 is detected by the density sensor 17, and the detection result is sent to the controller control section 15 through a serial communication line 33. The controller control section 15 corrects the gray scale-density characteristic of the image data received through an external interface based on the received density information on the toner patch.

In addition, the controller control section 15 also has a role of commanding a specific action of the engine control section 16 to the engine control section 16 through the serial communication line 33. The command of the specific action is sent to a one-chip microcomputer 34 serving as image forming means and paper feed control means by the engine control I/O 27.

That is, the one-chip microcomputer 34 controls each part in the engine control section 16 according to a command of the controller control section 15. Moreover, the controller control section 15 is capable of knowing internal information on the engine control section 16 through the serial communication line 33. First, an initial density correction processing will be explained.

The controller control section 15 issues an initial density correction operation command to the one-chip microcomputer 34 through the engine control I/O 27 after power on, lapse of a predetermined time, or exchange of a consumable (e.g., the toner and the intermediate transfer belt). Upon reception of the initial density correction operation command, the one-chip microcomputer 34 activates a laser scanner motor driver 36, and rotates a laser scanner motor 37. At the same time, the one-chip microcomputer 34 activates an image forming system motor driver (a part of various motor drivers 70) that is a driver for a motor used for image forming. As a result, an image forming system motor (a part of various motors 71) that is a motor used for the image forming is made to rotate, and the photoconductor drum 1 and the intermediate transfer belt 8 are made to rotate.

When having detected that a rotation frequency of the laser scanner motor 37 reaches a predetermined value, the one-chip microcomputer 34 outputs a laser forced light command to a laser control circuit 38. When having received the laser forced light command, the laser control circuit 38 drives a laser driver 39, and makes a semiconductor laser 40 emit light.

A laser beam emitted from the semiconductor laser 40 is irradiated to the polygon mirror (not illustrated) that is being rotated by the laser scanner motor 37, and is reflected by a reflecting mirror (not illustrated) of the polygon mirror. The beam reflected by the reflecting mirror scans on the photoconductor drum 1 in synchronization with the rotation of the polygon mirror. On the other hand, a part of the reflected beam of the polygon mirror enters into the beam photodetector 41. The beam that entered into the beam photodetector 41 is converted into an electric signal, and is further converted into the digital pulse signal by a beam detection circuit 42.

The pulse signal outputted by the beam detection circuit 42 is inputted into the laser control circuit 38, and is sent to the controller control section 15 as the horizontal synchronization signal 31. When the laser control circuit 38 comes to a state of being capable of outputting the horizontal synchronization signal, it halts forced full lighting of the semiconductor laser 40, but makes the semiconductor laser 40 partially light so that the laser beam may irradiate only a vicinity of the beam photodetector.

On the other hand, after the one-chip microcomputer 34 started the rotation of the image forming system motor (a part of the various motors 71), it applies a high voltage sequentially to the electrostatic charger 2, the developing unit 4, the primary transfer unit 9, and the cleaning roller 18. When the image forming apparatus comes to a state of forming the latent image, the one-chip microcomputer 34 notifies the controller control section 15 of information that it is ready to receive the image signal for density adjustment through the serial communication line 33.

The CPU 21 recognizes the notified information through the engine control I/O 27, and commands the data-for-correction generation circuit 30 to generate a predetermined patch image required for the initial density correction operation. The data-for-correction generation circuit 30 generates predetermined patch data for each color, for example a 10-mm side square whose density is converted into ten stages. Toner patches are generated based on the predetermined patch data at a position at which the density sensor 17 can detect.

Specifically, the CPU 21 places the DMA controller 26 in an active state. The DMA controller 26 reads the pixel data of a patch image from the data-for-correction generation circuit 30, and outputs image data for patch image as the serial image signal 32 to the laser control circuit 38 being synchronized with the horizontal synchronization signal 31. The laser control circuit 38 drives the laser driver 39 based on the image signal 32, and makes the semiconductor laser 90 output a beam modulated by the image signal for density control. The modulated beam enters into the polygon mirror, and after being reflected by the reflecting mirror of the polygon mirror, is irradiated to the surface of the photoconductor drum 1. If the polygon mirror rotates in such a state, an angle of the reflecting mirror varies periodically and the modulated beam is made to scan on the photoconductor drum 1. The surface of the photoconductor drum 1 is charged by the electrostatic charger 2, and by the modulated laser beam being scanned on the surface of the charged drum, the latent image is formed on the surface of the photoconductor drum 1.

Figure 4:
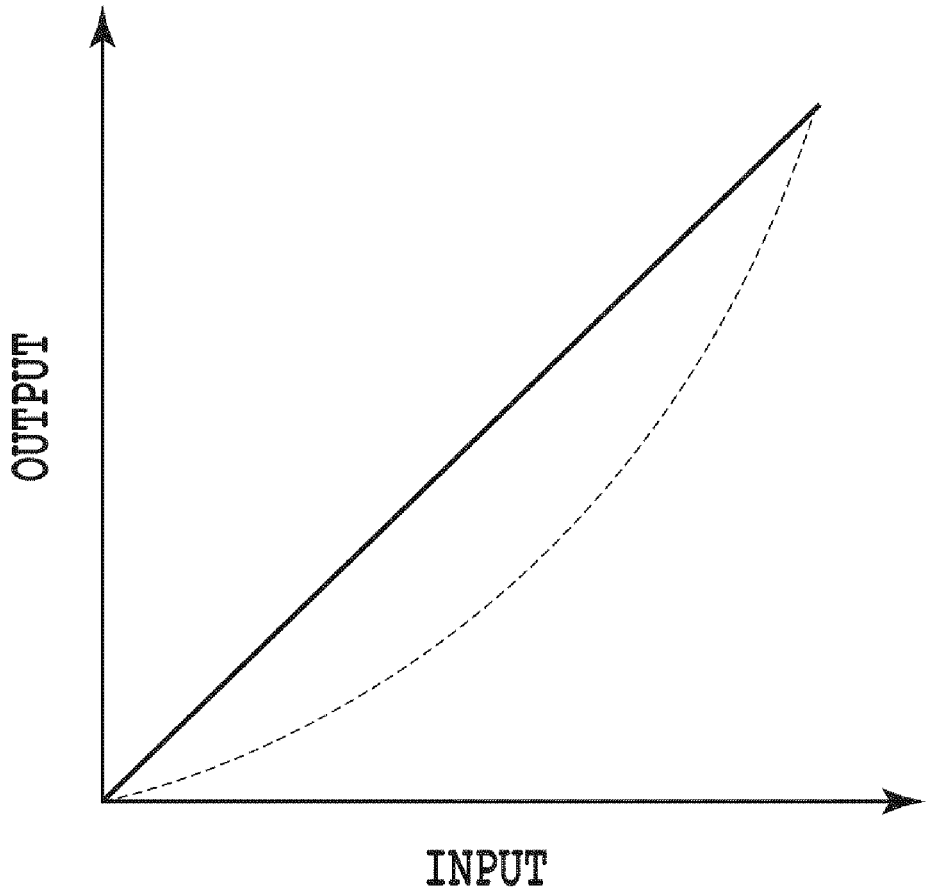
FIG. 4 is an input-output (gray scale-density) characteristic diagram in the first embodiment of the present invention.

The formed latent image is developed by the developing unit 4 as the toner patch, and the developed toner patch is transferred onto the intermediate transfer belt 8 by the primary transfer unit 9. When the toner patch transferred onto the intermediate transfer belt 8 reaches a position of the density sensor 17, the one-chip microcomputer 34 makes the density sensor 17 detect a node, and read the obtained data. The microcomputer 34 creates density data to each gray scale from the toner patch data of a plurality of gray scales having been determined in advance. The created density data is sent to the controller control section 15 through the serial communication line 33. The CPU 21 executes input gray scales adjustment (alteration of image forming conditions) using the received density data so that the input-output (gray scale-density) characteristic shown by a dotted line of FIG. 4 is established. FIG. 4 is a diagram showing the gray scale-density characteristic in an initial state of the printer, and if the density is adjusted along with this characteristic, it will become possible to perform development and fixing under proper conditions.

Incidentally, the toner patch on the intermediate transfer belt 8 is transferred onto the cleaning roller 18 charged to the opposite polarity to the toner by the high voltage generation circuit 43. The toner patch on the cleaning roller 18 is scraped off from the roller by the blade 19, and is discarded in the exhaust toner box 20. After cleaning of all the toner patches on the intermediate transfer belt 8 is completed, the one-chip microcomputer 34 halts respective operations sequentially.

Next, a printing operation will be explained. The controller control section 15 receives a print command from the host computer (not illustrated) through the external interface. If the CPU 21 determines that the code data received from the host computer amounted to 1 page, it will transmit the cassette paper feed command to the one-chip microcomputer 34 through the engine control I/O 27 to start printing. Upon reception of the cassette paper feed command, the one-chip microcomputer 34 will activate the laser scanner motor driver 36, and will rotate the laser scanner motor 37.

Similarly, the one-chip microcomputer 34 rotates the various motors 71 by activating the various motor drivers 70 of conveyance, the image forming system, or fixing, and rotates the photoconductor drum 1, and a heat roller and a pressure roller in the fixing unit 11. Moreover, the various motors 71 each have a role of conveying the paper.

When having detected that the rotation frequency of the laser scanner motor 37 reaches the predetermined value, the one-chip microcomputer 34 outputs the laser forced light command to the laser control circuit 38. The laser beam irradiated from the semiconductor laser 90 is directed to the polygon mirror (not illustrated) being rotated by the laser scanner motor 37, and is irradiated to the reflecting mirror (not illustrated). The irradiated beam is reflected by the reflecting mirror and is directed onto the photoconductor drum 1. Moreover, on the other hand, a part of the reflected beam from the polygon mirror enters into the beam photodetector 41. If the polygon mirror rotates in such a state, an angle of the reflecting mirror varies periodically and the beam scans on the photoconductor drum 1.

A pulse signal outputted from the beam detection circuit 42 enters into the laser control circuit 38, and the pulse signal is sent to the controller control section 15 as the horizontal synchronization signal 31. When the laser control circuit 38 comes to be able to output the horizontal synchronization signal, it halts the forced full lighting of the semiconductor laser 40, and makes the semiconductor laser 40 partially light so that the laser beam may scan only on the vicinity of the beam photodetector.

On the other hand, the one-chip microcomputer 34 applies the high voltage sequentially to the electrostatic charger 2, the developing unit 4, the primary transfer unit 9, and the secondary transfer unit 10 through the high voltage generation circuit 43 after starting to rotate the various motors 71. When the device comes to a state of being capable of forming the latent image with the high voltage, the one-chip microcomputer 34 notifies the controller control section 15 of information that it is ready to receive the image signal through the serial communication line 33.

The CPU 21 recognizes the received information through the engine control I/O 27, and places the DMA controller 26 in an active state. The DMA controller 26 reads the pixel data from the RAM 23, and outputs the serial image signal 32 to the laser control circuit 38 being synchronized with the horizontal synchronization signal 31.

The laser control circuit 38 drives the laser driver 39 based on the image signal 32, and makes the semiconductor laser 40 output a beam modulated by the image signal. The modulated beam enters into the polygon mirror and is reflected by the reflecting mirror of the polygon mirror, and subsequently is scanned on the surface of the photoconductor drum 1. The surface of the photoconductor drum 1 is charged by the electrostatic charger 2, and by the modulated laser beam being scanned on the surface of the charged drum, the latent image is formed on the surface of the photoconductor drum 1. The latent image is developed into the toner image by the developing unit 4, and is transferred onto the intermediate transfer belt 8 by the primary transfer unit 9.

On the other hand, after the one-chip microcomputer 34 checks that a temperature of the heat roller in the fixing unit 11 rises to a predetermined value after starting rotation of the various motors 71, it drives the paper feed roller 6 to feed the paper loaded on a paper cassette 5 forward therefrom. The fed paper halts once at the resist roller 7. The one-chip microcomputer 34 drives the resist roller 7 so that the toner image transferred on the intermediate transfer belt 8 may come to a position superposing exactly on the conveyed paper.

Here, the driving of the paper feed roller 6 and the resist roller 7 is turned ON and OFF by various solenoids 44. When the paper conveyed by the driving of the resist roller 7 is conveyed to a position at which it superposes on the toner image, the toner image on the intermediate transfer belt 8 is transferred onto the paper by the secondary transfer unit 10. The paper on which the toner image was transferred is conveyed to between the heat roller and the pressure roller inside the fixing unit 11. That is, the toner on the conveyed paper is fixed with heat and pressure received from the heat roller and the pressure roller inside the fixing unit 11. Then, the paper with the toner fixed thereon is discharged to the paper discharge tray 14 by the paper discharge roller 13.

Incidentally, in this fixing process of toner, the surface temperature of the heat roller inside the fixing unit 11 is maintained at a constant temperature by the one-chip microcomputer 34. Concretely, when the surface temperature of the heat roller inside the fixing unit 11 is transmitted to a thermistor (not illustrated), the one-chip microcomputer makes a heat roller heater 76 turn ON and OFF through a heater driver 45 so that an output value of the thermistor may become a predetermined value. Thereby, the surface temperature of the heat roller inside the fixing unit 11 is maintained at the constant value. Moreover, unnecessary toner that was not transferred onto the paper but remained on the surface of the photoconductor drum 1 is recovered in the exhaust toner box 20 by the cleaning roller 18. The one-chip microcomputer 34 halts respective operations sequentially after the cleaning on the intermediate transfer belt 8 is completed.

Figure 5:
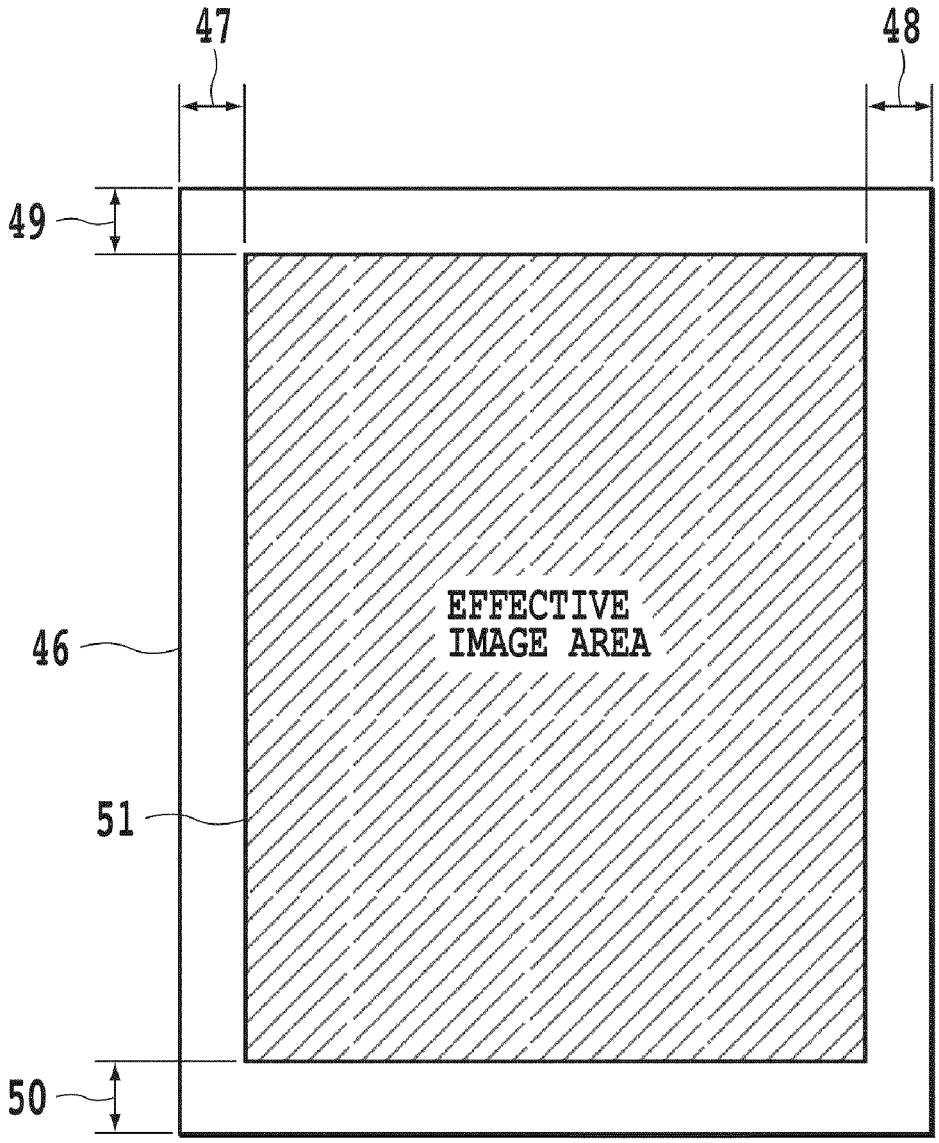
FIG. 5 is a schematic diagram showing an effective image area to a paper sheet in the first embodiment of the present invention.

FIG. 5 is a schematic diagram showing an effective image area to the paper sheet. In FIG. 5, a paper sheet 46 has an effective image area 51 excepting blank portions of a left end blank 47, a right end blank 48, a leading end blank 49, a rear end blank 50, etc. The CPU 21 receives information on the left end blank 47, the right end blank 48, the leading end blank 49, and the rear end blank 50 from the host computer in advance through the external interface, and secures a domain of the RAM 23 (bit map memory) necessary to store the pixel data.

Figure 6:
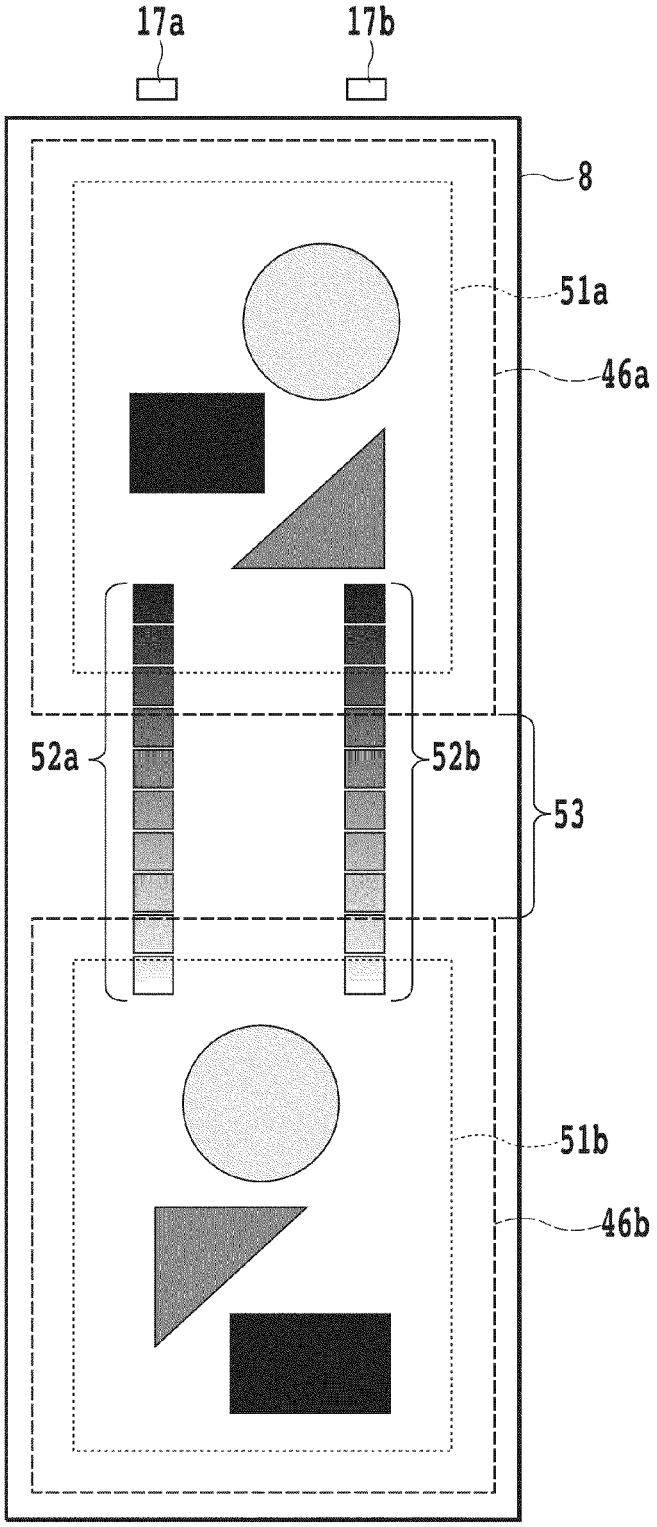
FIG. 6 is a schematic diagram in which positions of the paper sheet and an image during continuous printing in the first embodiment of the present invention are virtually projected onto an intermediate transfer belt.

FIG. 6 is a schematic diagram in which positions of the paper sheet and the image during continuous printing are virtually projected onto the intermediate transfer belt. In this embodiment, as shown in FIG. 6, a patch image 52*a* and 52*b* during the continuous printing is printed exceeding an interval between paper sheets (hereinafter called a space between paper sheets) 53 during the continuous printing that is projected onto the intermediate transfer belt.

Figures 7, 7A:
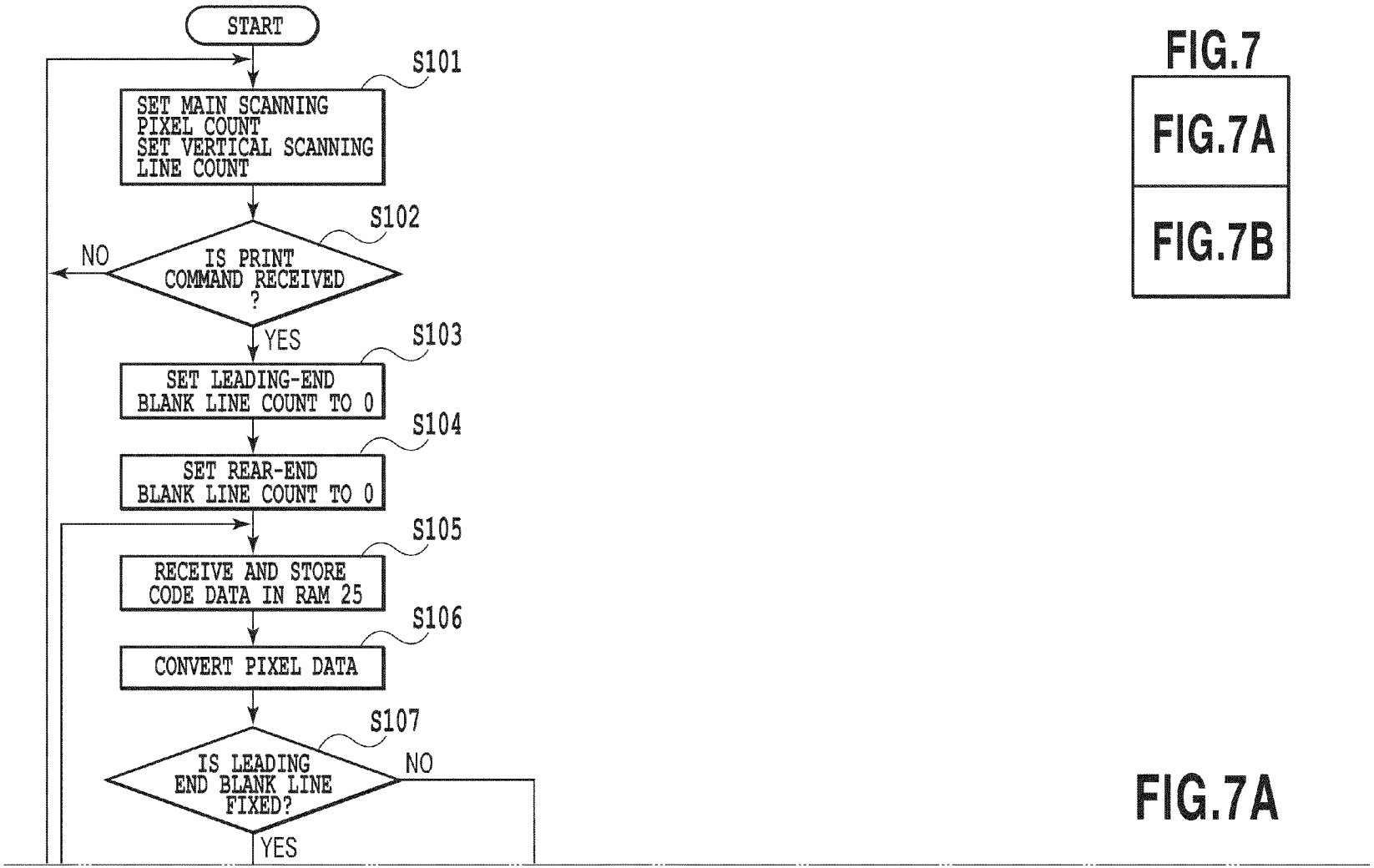
FIG. 7 is a diagram showing the relationship between FIGS. 7A and 7B.
FIG. 7A is a flowchart of a processing of identifying a blank portion of the effective image area in the first embodiment of the present invention.
Figure 7B:
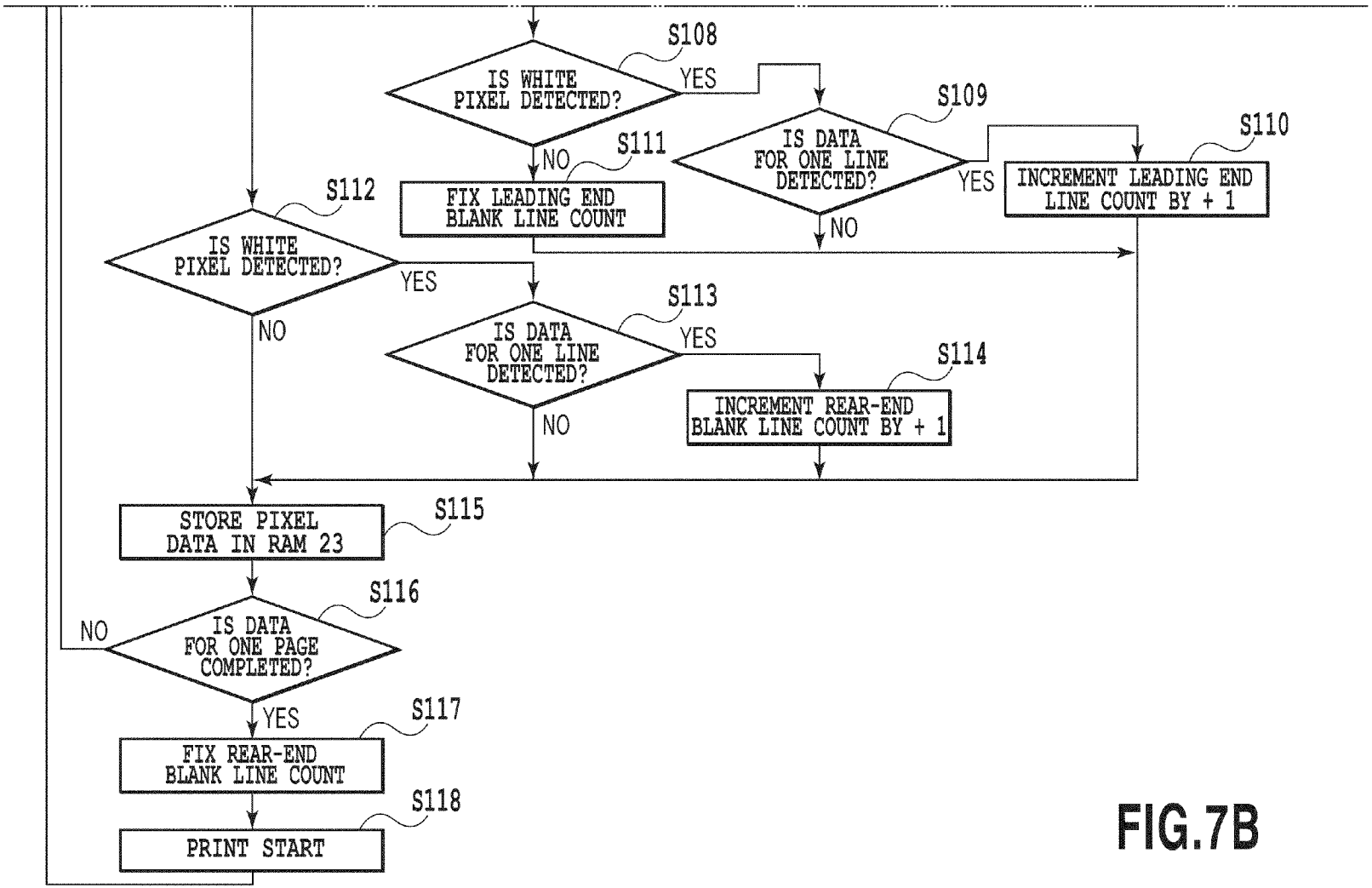
FIG. 7B is a flowchart of a processing of identifying a blank portion of the effective image area in the first embodiment of the present invention.

FIGS. 7A and B are a flowchart showing a blank identification processing in which the CPU 21 identifies a blank portion of the effective image area comparing it with the recording material. At S101 shown in FIG. 7A, the CPU 21 receives information on the left end blank 47, the right end blank 48, the leading end blank 49, and the rear end blank 50, and sets up the pixel count in a main scanning direction that is perpendicular to the conveyance direction and the line count in the sub scanning direction parallel to the conveyance direction.

At S102, it is determined whether the print command was received from the host computer and, if it is received, the process will shift to S103. At S103, a leading-end blank line count buffer for storing the line count of the leading-end blank portion of the effective image area is cleared.

At S104, a rear-end blank line count buffer for storing the line count of the rear-end blank portion of the effective image area is cleared. At S105, the code data is received and stored in the RAM 25. At S106, the received code data is converted into the pixel data. At S107, it is determined whether a leading-end blank line count is fixed and, if it is not fixed, the process will shift to S108, and if it is fixed, the process will shift to S112. At S108, it is determined whether the pixel data converted at S106 is white pixel data (data that indicates a state where the toner is not put on) and, if it is the white pixel data, the process will shift to S109, and if it is not the white pixel data, the process will shift to S111. At S109, it is determined whether the white pixel data continues for one line (the pixel count in the main scanning direction) and, if the white pixel data continues for one line, the process will shift to S110, and if the consecutive white pixel data does not amount to one line, the process will shift to S115. At S110, a value of the leading-end blank line count buffer is incremented by +1. At S111, it is determined that the blank line from the leading end broke off, and the value of the leading-end blank line count buffer is fixed. At S112, it is determined that after the leading-end blank line count is fixed, a beginning of a rear-end blank line count is detected, and it is determined whether the pixel data converted at S106 is the white pixel data. If it is the white pixel data, the process will shift to S113, and it is not the white pixel data, the process will shift to S115.

At S113, it is determined whether the white pixel data continues for one line (a pixel count in the main scanning direction) and, if the white pixel data continues for one line, the process will shift to S114, and if the consecutive white pixel data does not amount to one line, the process will shift to S115. At S114, the value of the rear-end blank line count buffer is incremented by +1. At S115, the pixel data gets stored in the RAM 23. At S116, it is determined whether the pixel data for one page was processed and, if the processing is not completed, the process will return to S105, and if the processing for one page is completed, the process will shift to S117. At S117, it is determined that the processing for one page is completed, and the value of the rear-end blank line count buffer is fixed. At S118, the above-mentioned printing operation is started and the process returns to S101, where a processing of identifying the blank portion of the effective image area on the next page is started.

Next, the density correction operation during the continuous printing will be explained using FIG. 5, FIG. 6 and FIGS. 7A and B. Incidentally, since the image forming processing at the time of the continuous printing is the same as that of the time of one-sheet printing described above, an explanation not related to the density correction operation is omitted.

The CPU 21 designates, as the rear-end blank line count, a line count obtained by adding a line count corresponding to the rear end blank 50 to a rear-end blank line count of the n-th page that was fixed by the processing of identifying the blank portion of the effective image area. Similarly, the CPU 21 designates, as the leading-end blank line count, a line count obtained by adding a line count corresponding to the leading end blank 49 to a leading-end blank line count of the (n+1)th page that was fixed by the processing of identifying the blank portion of the effective image area. Therefore, an area of a line count obtained by summing a line count between paper sheets corresponding to the space between paper sheets, the rear-end blank line count of the n-th page, and the leading-end blank line count of the (n+1)th page becomes an area in which the density correction operation between the n-th page and the (n+1)th page can be performed. The CPU 21 receives the code data of the (n+1)th page, secures an area in which the density correction operation between the n-th page and the (n+1)th page can be performed, and sends the information on the patch image to the one-chip microcomputer 34 through the serial communication line 33.

The information on the patch image includes a starting position of the patch image, an end position thereof, the number of patches, a color of the patch, the density of each patch, etc. When the printing of the n-th page is started and the image forming processing is performed up to the starting position of the patch image, the CPU 21 commands the data-for-correction generation circuit 30 to generate a predetermined patch image required for the density correction processing between paper sheets, and places the DMA controller 26 in an active state. The one-chip microcomputer 34 receives the cassette paper feed command for the n-th page and performs an image forming processing of the n-th page. Together with this, based on information on the patch image, the one-chip microcomputer 34 starts to read data of the density sensor 17 at a timing when a starting portion of the toner patch formed on the intermediate transfer belt 8 reaches the position of the density sensor 17. The one-chip microcomputer 34 creates the density data with respect to gray scales from the read toner patch data, and sends it to the controller control section 15 through the serial communication line 33.

The cleaning roller 18 is charged to the opposite polarity to the toner by the high voltage generation circuit 43 only at an area formed on the intermediate transfer belt 8, and the toner patch on the intermediate transfer belt 8 is transferred onto the cleaning roller 18. The toner on the cleaning roller 18 is scraped off by the blade 19 from the roller, and is discarded into the exhaust toner box 20. Moreover, in parallel with reading of the patch image, the one-chip microcomputer 34 receives the cassette paper feed command of the (n+1)th page, and feeds (n+1)th page paper loaded on the paper cassette 5 by driving the paper feed roller 6. The fed paper is made to halt at the resist roller 7. The one-chip microcomputer 34 notifies the controller control section 15 of the information that it is ready to receive the image signal through the serial communication line 33.

The CPU 21 recognizes this information through the engine control I/O 27, and places the DMA controller 26 in an active state in order to form an image of the (n+1)th page. Then, the one-chip microcomputer 34 drives the resist roller 7 so that the toner image of the (n+1)th page transferred onto the intermediate transfer belt 8 may be correctly transferred onto the conveyed paper.

Incidentally, if the CPU 21 determines that entire required toner patches cannot be formed, the required toner patches are divided and the divided toner patches are formed among a plurality of spaces each between paper sheets during the continuous printing. The one-chip microcomputer 34 receives division information on the patch images through the serial communication line 33 and acquires data of all the divided patch images, and subsequently creates the density data and sends it to the controller control section 15 through the serial communication line 33. The CPU 21 executes the input gray scales adjustment (alteration of image forming conditions) using the received density data so that an input-output (gray scale-density) characteristic shown by a solid line of FIG. 4 is established. Specifically, the required characteristic is gained by turning up the dotted line of FIG. 4 symmetrically to the solid line of FIG. 4, for example, if density characteristic shown by a dotted line of FIG. 4 is gained using the toner patches. As for an image of each page, the gray scales adjusts by using the characteristic.

As described above, according to the first embodiment, the density correction operation can be performed in an area of a line count obtained by summing the line count corresponding to the space between paper sheets, the rear-end blank line count of the n-th page, and the leading-end blank line count of the (n+1)th page, and therefore it becomes possible to form more patch images.

Second Embodiment

Figure 8:
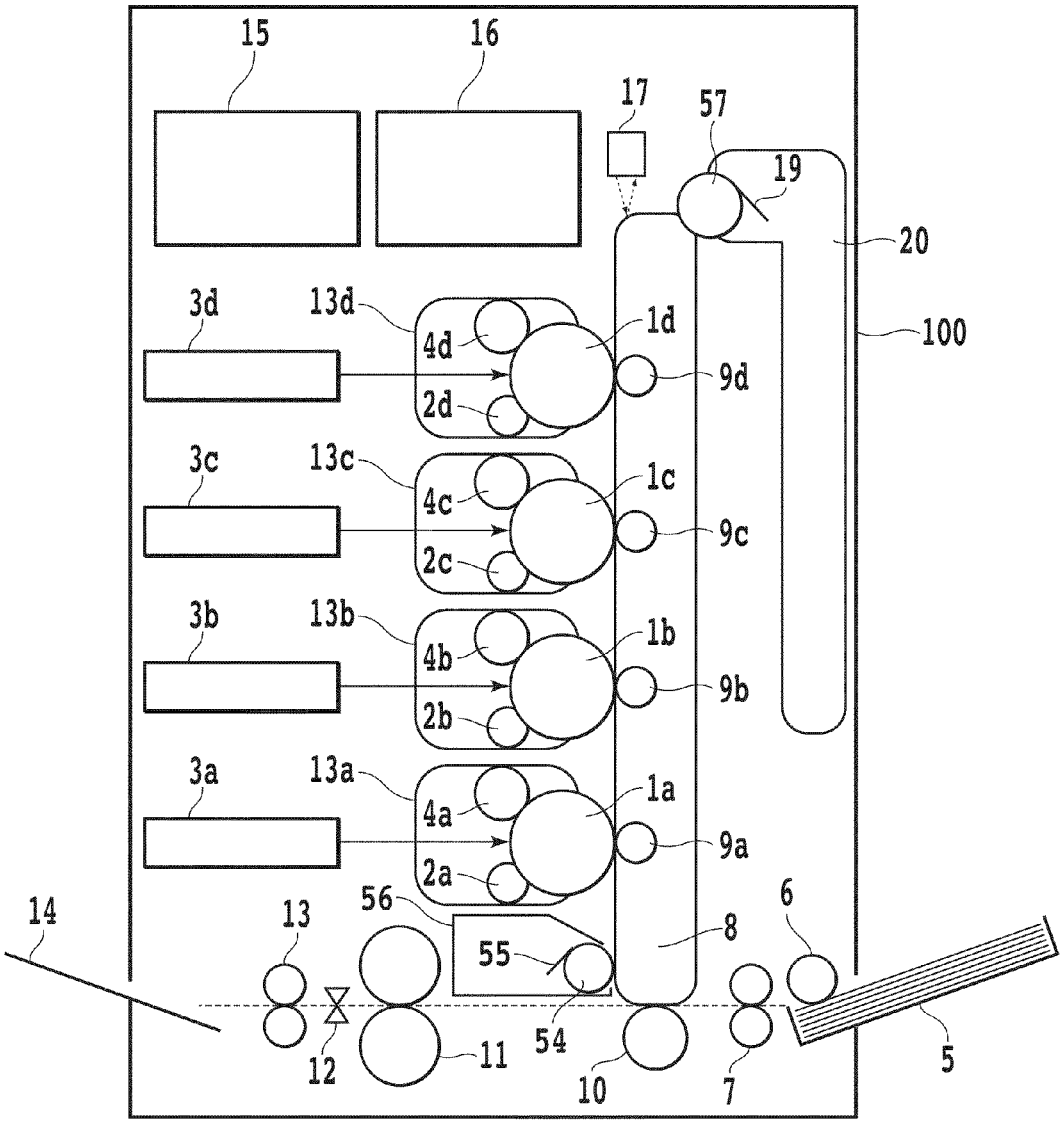
FIG. 8 is a sectional view of a color printer in a second embodiment of the present invention.
Figure 9:
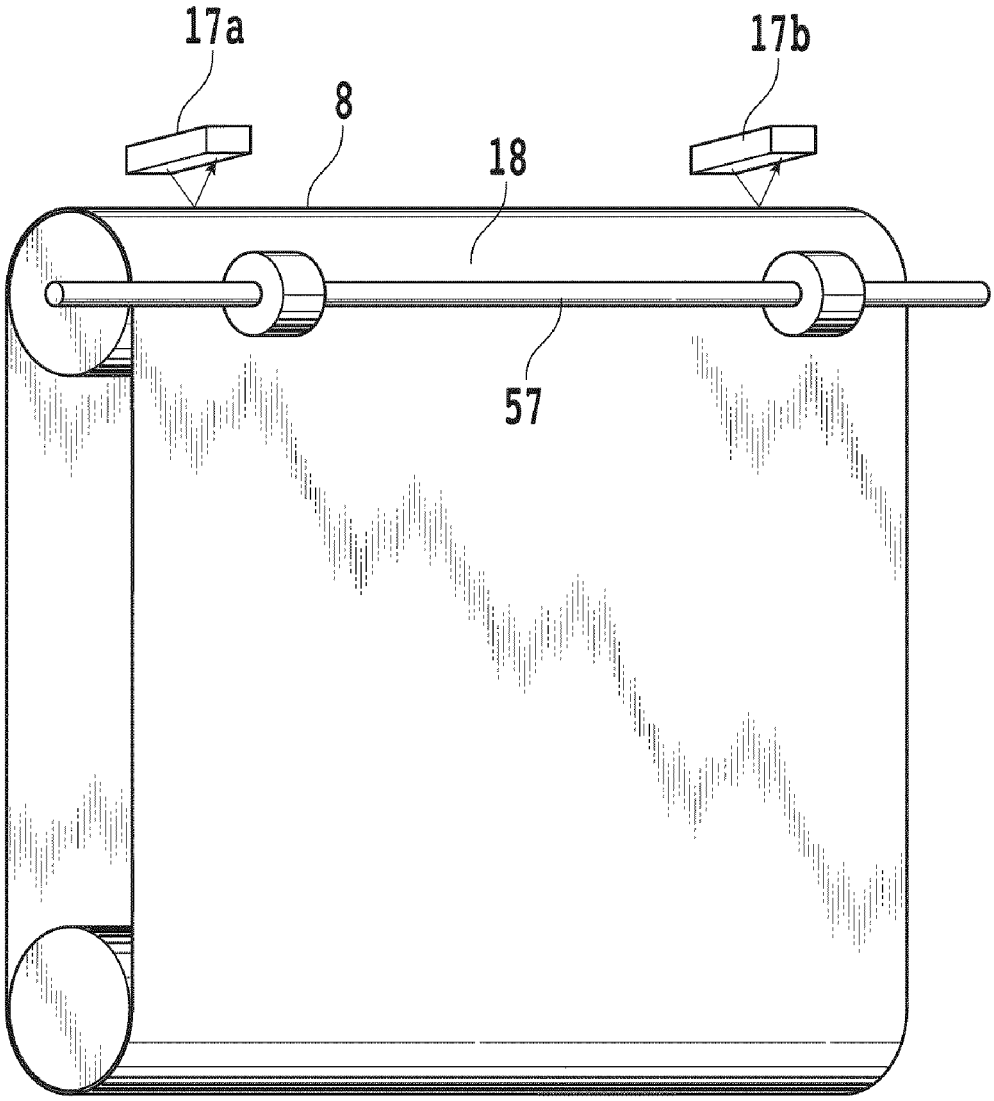
FIG. 9 is a diagram showing an arrangement configuration of the color printer in the second embodiment of the present invention.

FIG. 8 is a sectional view of a color printer showing a feature of a second embodiment. FIG. 9 is a diagram showing an arrangement configuration of the color printer of the second embodiment. In an explanation of this embodiment, any part having the same function as that of the configuration of the first embodiment is given the same numeral. In FIG. 8 and FIG. 9, a cleaning roller 54 removes the toner image from the intermediate transfer belt 8 by applying electric charges of the opposite polarity to the toner between the secondary transfer unit 10 and the primary transfer unit 9. A blade 55 scrapes off the toner on the cleaning roller 54, and an exhaust toner box 56 collects the toner that is scraped off by the blade 55. A cleaning roller 57 adds electric charges of the opposite polarity to the toner between the density sensor 17 and the secondary transfer unit 10, and thereby removes the toner image from the intermediate transfer belt 8.

Incidentally, the cleaning roller 57 is abutting the intermediate transfer belt 8 only at a portion thereof corresponding to the size of the patch image, and has a shape such that it does not transfer the toner except a portion where the toner patch is formed even when applying electric charges of the opposite polarity to the toner.

Figure 10:
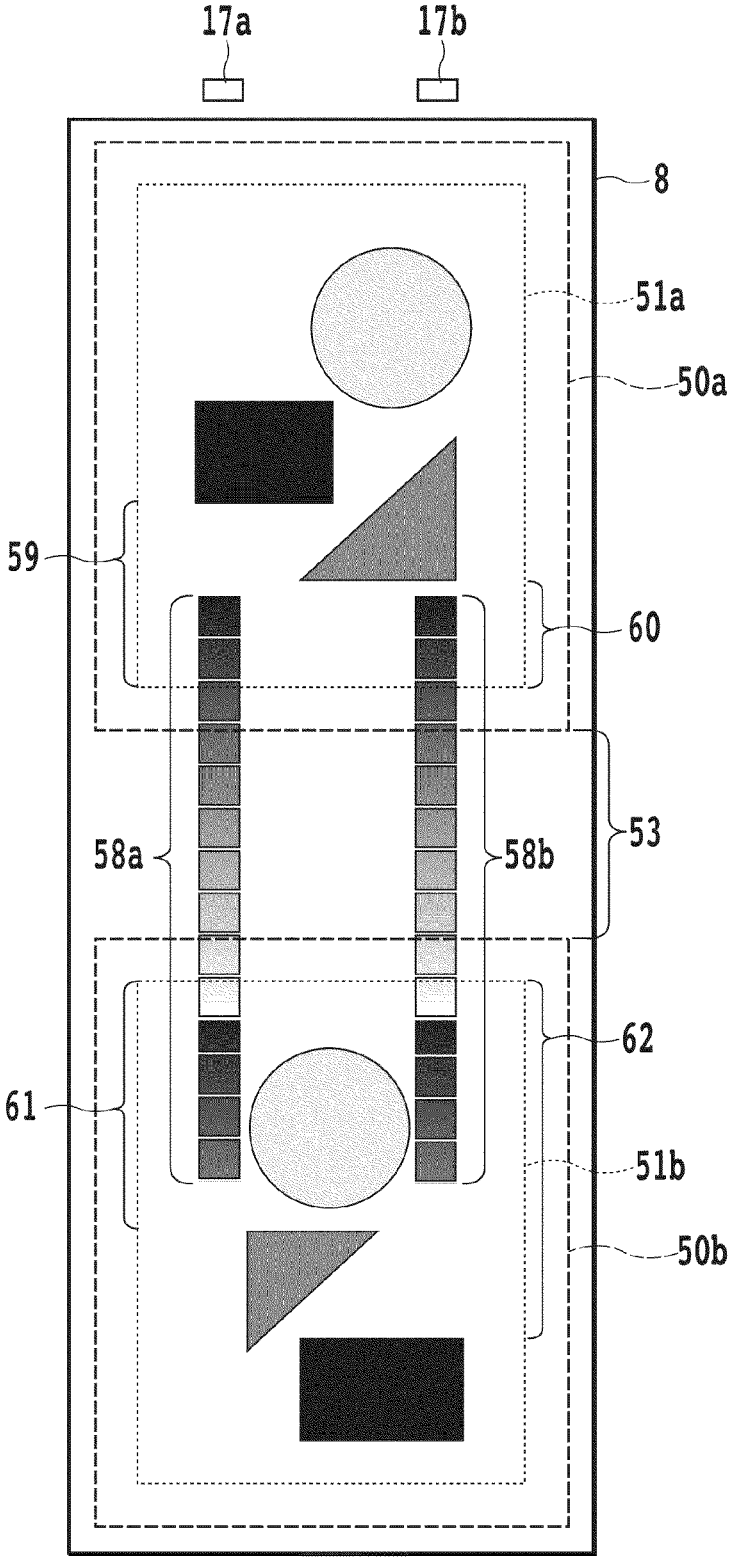
FIG. 10 is a schematic diagram in which positions of the paper sheet and the image during the continuous printing in the second embodiment of the present invention are virtually projected onto the intermediate transfer belt.

FIG. 10 is a schematic diagram in which positions of the paper sheet and the image during the continuous printing of this embodiment are virtually projected onto the intermediate transfer belt. In FIG. 10, a patch image 58*a* during the continuous printing is read by a density sensor 17*a*, and a toner patch 58*b* during the continuous printing is read by a density sensor 17*b*. A blank portion of an image area (hereinafter referred to as a rear-end left blank) 59 corresponds to the position of the toner patch of the previous page read by the density sensor 17*a*, and a blank portion of an image area (hereinafter referred to as a rear-end right blank) 60 corresponds to the position of the toner patch of the previous page read by the density sensor 17*b*. A blank portion of an image area (hereinafter referred to as a leading-end left blank) 61 corresponds to the position of the toner patch of the subsequent page read by the density sensor 17*a*, and a blank portion of an image area (hereinafter referred to as a leading-end right blank) 62 corresponds to the position of the toner patch of the subsequent page read by the density sensor 17*b*.

Figures 11, 11A:
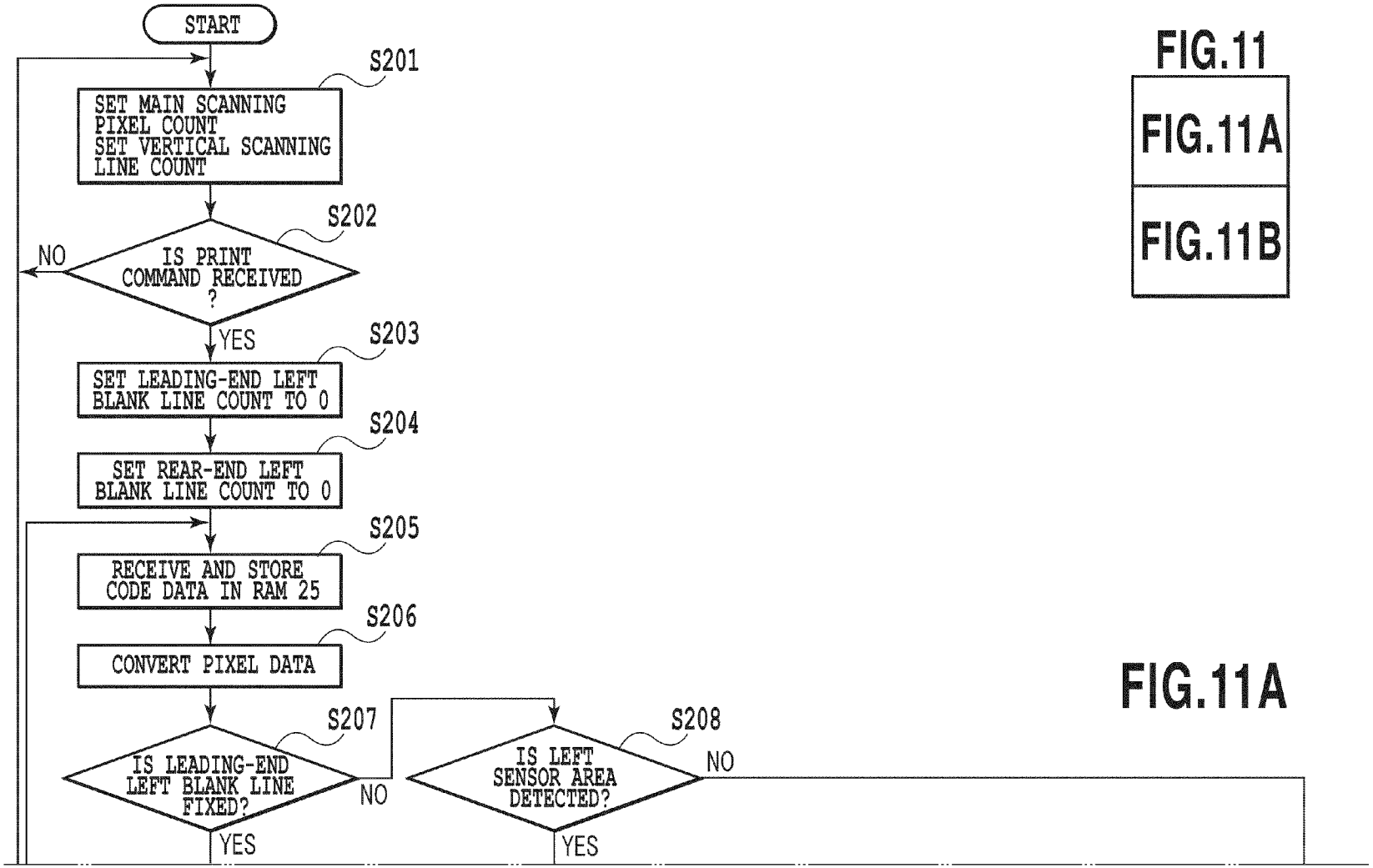
FIG. 11 is a diagram showing the relationship between FIGS. 11A and 11B.
FIG. 11A is a flowchart of a processing of identifying a blank portion of the effective image area in the second embodiment of the present invention.
Figure 11B:
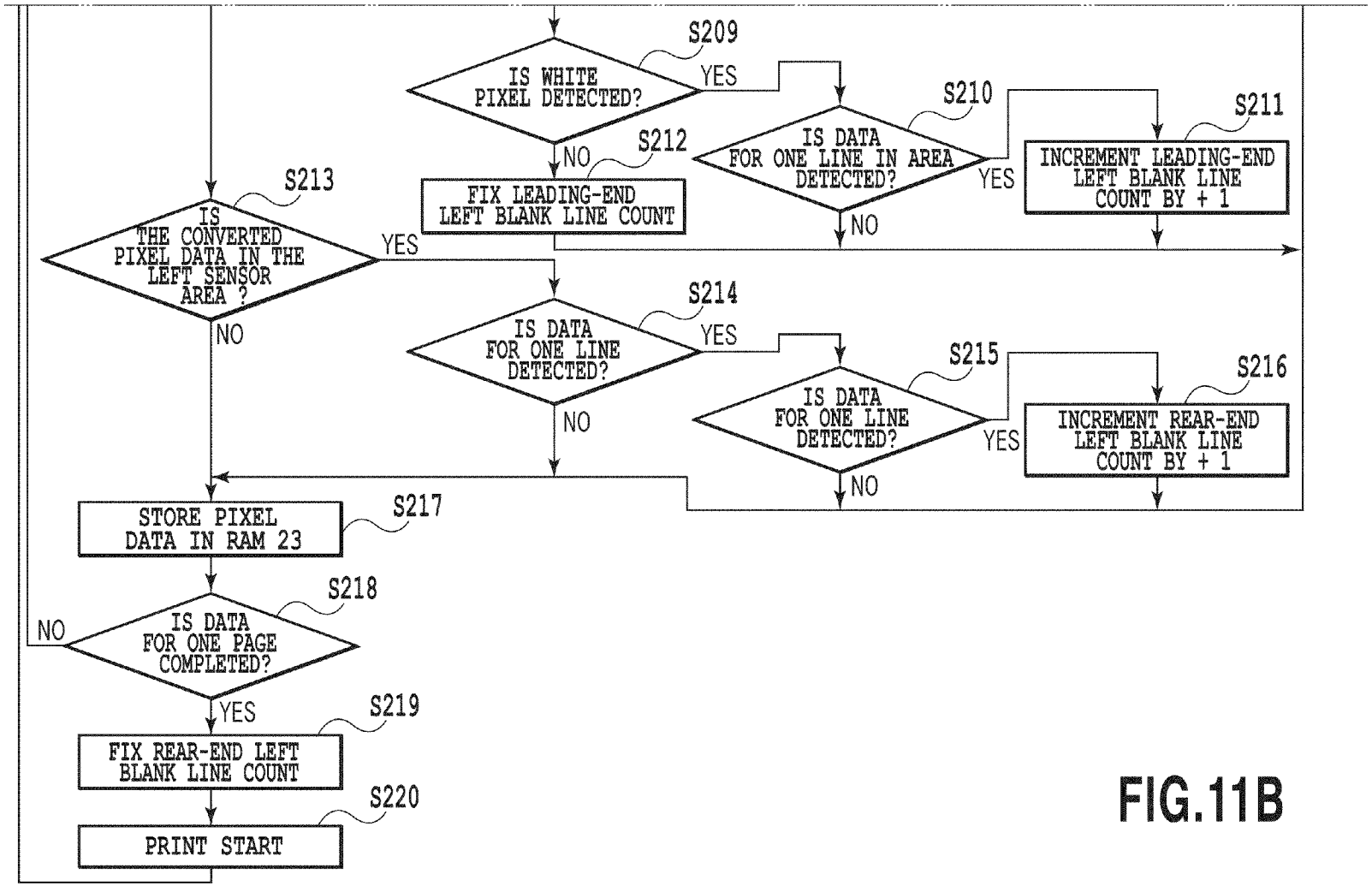
FIG. 11B is a flowchart of a processing of identifying a blank portion of the effective image area in the second embodiment of the present invention.
Figures 12, 12A, 12B:
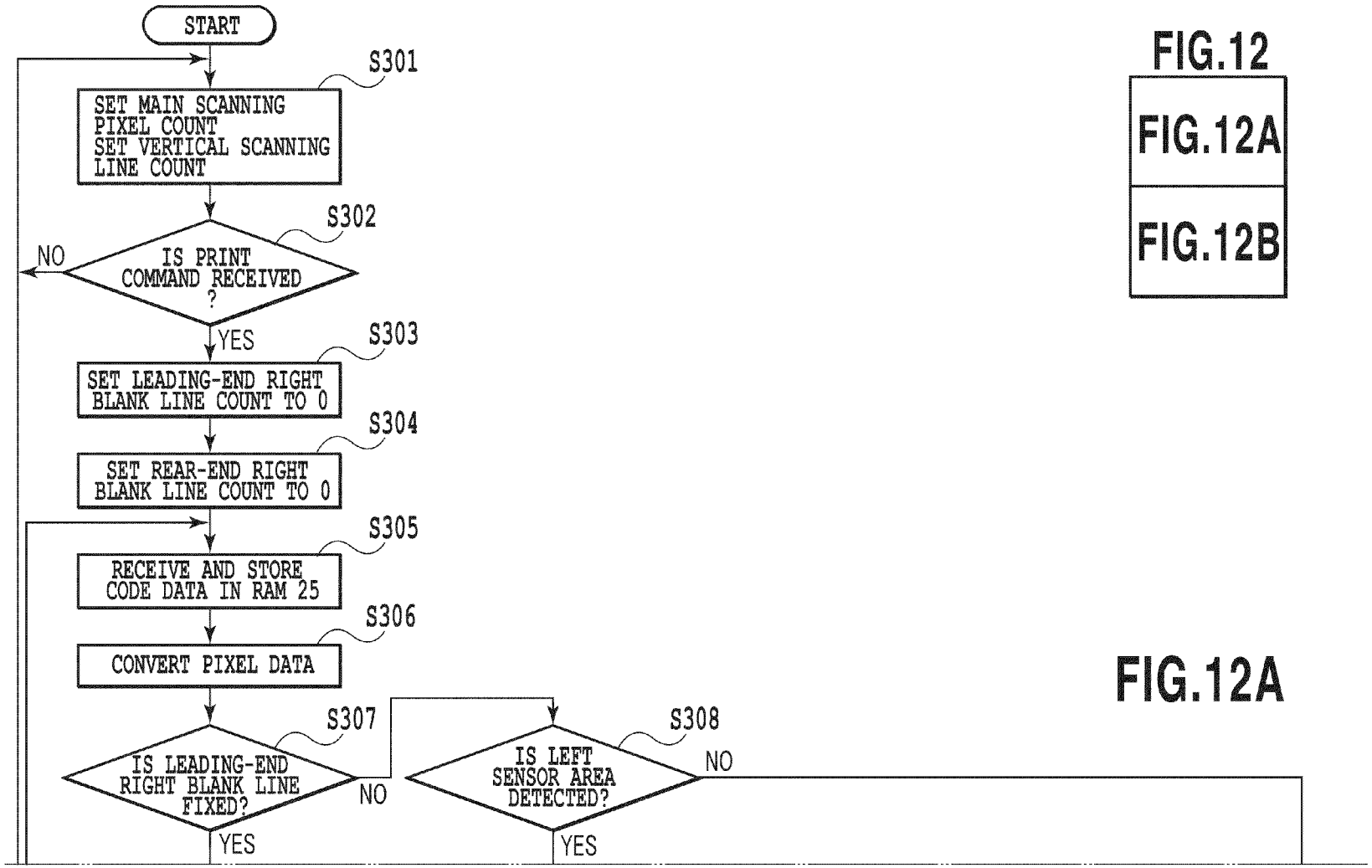
FIG. 12 is a diagram showing the relationship between FIGS. 12A and 12B.
FIG. 12A is a flowchart of a processing of identifying the blank portion of the effective image area in the second embodiment of the present invention.
FIG. 12B is a flowchart of a processing of identifying the blank portion of the effective image area in the second embodiment of the present invention.
Figure 12B:
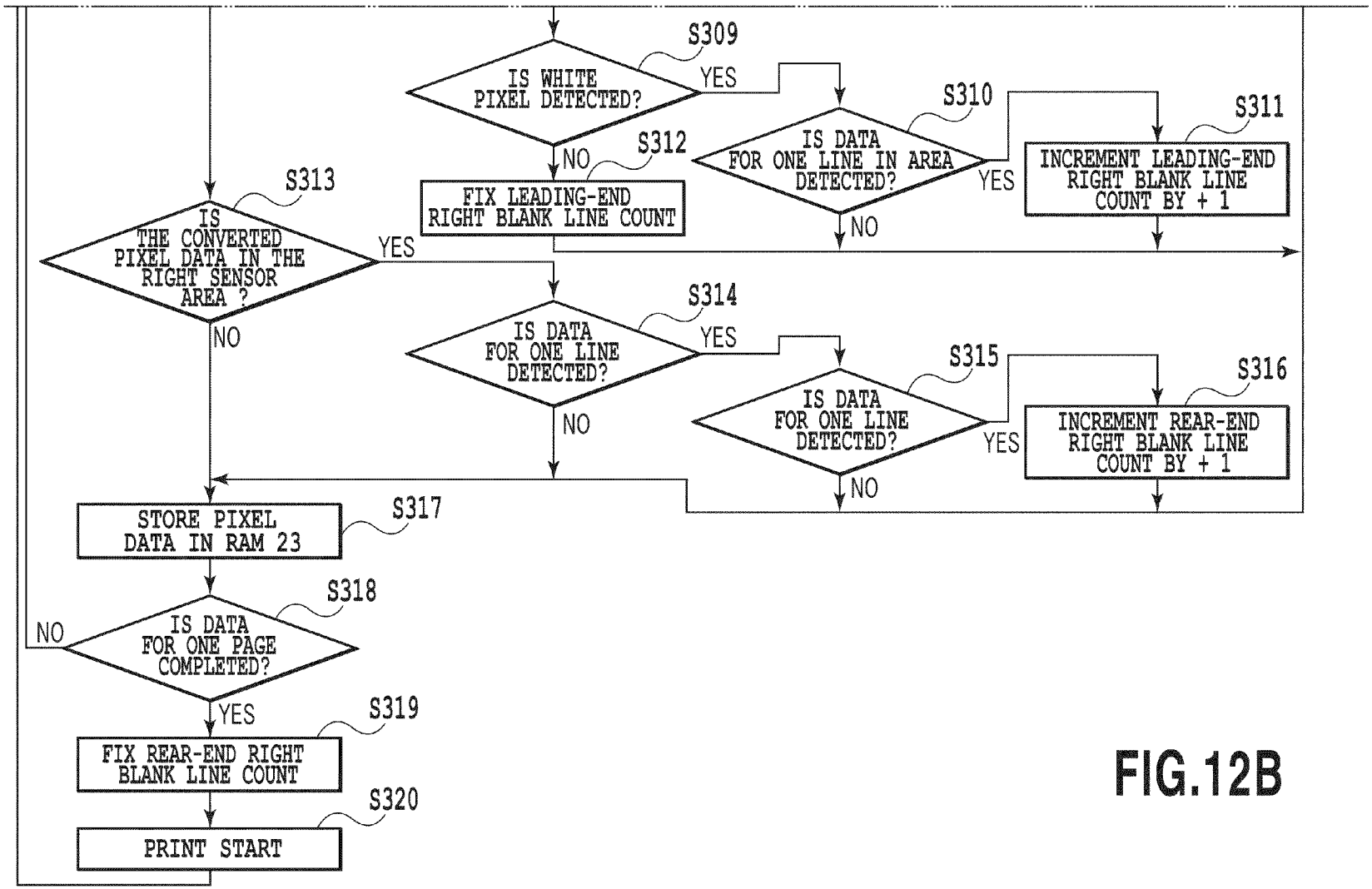

FIGS. 11 A and B are flowcharts of a processing of identifying the blank portion of the image area corresponding to the position of the toner patch read by the density sensor 17*a*, and FIGS. 12 A and B are flowcharts of a processing of identifying the blank portion of the image area corresponding to the position of the patch image read by the density sensor 17*b*. Since a difference of the processing between FIGS. 11A and B and FIGS. 12A and B is only a difference of the position of the toner patch at which being read, hereafter the explanation will be given referring to FIGS. 11 A and B and an explanation with respect to FIGS. 12A and B is omitted.

In FIG. 11A, at S201, the CPU 21 receives information on the left end blank 47, the right end blank 48, the leading end blank 49, and the rear end blank 50, and sets up the pixel count in the main scanning direction and the line count in a vertical scanning direction. At S202, it is determined whether the print command was received from the host computer and, if it is received, the process will shift to S203. At S203, a leading-end left blank line count buffer for storing the line count of a leading-end blank portion of an image area corresponding to a position of the toner patch read by the density sensor 17*a* is cleared.

At S204, a rear-end left blank line count buffer for storing the line count of a rear-end blank portion of the image area corresponding to the position of the toner patch read by the density sensor 17*a* is cleared. At S205, the code data is received and stored in the RAM 25. At S206, the received code data is converted into the pixel data. At S207, it is determined whether a leading-end left blank line count is fixed and, if it is not fixed, the process will shift to S208, and if it is fixed, the process will shift to S214. At S208, it is determined whether the pixel data converted at S206 is in the image area corresponding to the position of the toner patch read by the density sensor 17*a* and, if it is in the image area, the process will shift to S209, and if is outside the image area, the process will shift to S217.

At S209, it is determined whether the pixel data is the white pixel data (data that indicates a state where a toner is not put on) and, if it is the white pixel data, the process will shift to S211, and if it is not the white pixel data, the process will shift to S212. At S210, it is determined whether the white pixel data continues for one line (pixel count in the main scanning direction) in an image area that corresponds to the position of the toner patch that is read by the density sensor 17*a*. If the white pixel data continues for one line, the process will shift to S211, and if the consecutive white pixel data does not amount to one line, the process will shift to S217. At S211, the value of the leading-end blank line count buffer is incremented by +1. At S212, it is determined that the blank line from the leading end in the image area corresponding to the position of the toner patch read by the density sensor 17*a* broke off, and the value of the leading-end blank line count buffer is fixed. At S213, it is determined whether the pixel data converted at S206 exists in an image area that corresponds to the position of the toner patch read by the density sensor 17*a* and, if it is in the image area, the process will shift to S214, and if it is outside the image area, the process will shift to S217.

At S214, since the beginning of the rear-end left blank line count is detected, it is determined whether the pixel data in the image area corresponding to the position of the patch image read by the density sensor 17*a* is the white pixel data and, if it is the white pixel data, the process will shift to S215. If it is not the white pixel data, the process will shift to S217. At S215, it is determined whether the white pixel data in the image area corresponding to the position of the toner patch read by the density sensor 17*a* continues for one line (the pixel count in the main scanning direction) and, if the white pixel data continues for one line, the process will shift to S216, and if the consecutive white pixel data does not amount to one line, the process will shift to S217. At S216, the value of the rear-end left blank line count buffer is incremented by +1. At S217, the pixel data is stored in the RAM 23.

At S218, it is determined whether the pixel data for one page was processed and, if the processing is not completed, the process will return to S205, and if the processing for one page is completed, the process will shift to S219. At S219, it is determined that the processing for one page was finished, and the value of the rear-end blank line count buffer is fixed. At S220, the above-mentioned printing operation is started, and the process of this processing returns to S201, where a processing on the next page is started in order to identify a blank portion in the image area corresponding to the position of the patch image read by the density sensor 17*a*.

Next, an operation in the density correction operation during the continuous printing in this embodiment that is different from that in the first embodiment will be explained. The CPU 21 fixes the rear-end left and right blank line counts of the n-th page by both a processing of identifying the blank portion of the image area corresponding to the position of the toner patch read by the density sensor 17*a* and a processing of identifying a blank portion of the image area corresponding to a position of the patch image read by the density sensor 17*b*.

The CPU 21 designates, as the rear-end blank line count, a line count obtained by adding the line count corresponding to the rear end blank 50 to a smaller one of the rear-end left and right blank line counts of the n-th page being fixed. Similarly, the CPU 21 fixes the leading-end left and right blank line counts of the (n+1)-th page by both a processing of identifying a blank portion of the image area corresponding to the position of the patch image read by the density sensor 17*a* and a processing of identifying a blank portion of the image area corresponding to the position of the patch image read by the density sensor 17*b*. The CPU 21 designates, as the leading-end blank line count, a line count obtained by adding the line count corresponding to the leading end blank 49 to a smaller one of the leading-end left and right blank line counts of the (n+1)-th page being fixed. Therefore, an area of a line count obtained by summing the line count corresponding to the space between paper sheets, the rear-end blank line count of the n-th page, and the leading-end blank line count of the (n+1)th page becomes an area in which the density correction operation can be performed between the n-th page and the (n+1)th page.

After fixing the area in which the density correction operation can be performed, operations equivalent to those of the first embodiment are performed except a cleaning operation below. Since the entire toner remaining on the intermediate transfer belt 8 cannot be removed by the cleaning roller 57 in this embodiment, the cleaning roller 54 is provided and the toner remaining on the intermediate transfer belt 8 is removed by it after completion of a secondary transfer. As described above, since toner patches for density correction can be formed in an area of a line count obtained by adding up the blank portion of the image area corresponding to the position of the toner patch read by the density sensor 17 and the line count corresponding to the space between paper sheets, it becomes possible to form much toner patches than those of the first embodiment. Incidentally, although the density correction was explained in the embodiment, this procedure is not limited to the density correction, but can also be applied to, for example, color blur correction whereby color blur is detected by a plurality of line-shape patches of different colors and is corrected.

Other Embodiments

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment (s). For this purpose, the program is provided to the computer for example via a network or from a recording medium of various types serving as the memory device (e.g., computer-readable medium).

While the present invention has been described With reference to exemplary embodiments and it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-115718 filed May 12, 2009 which is hereby incorporated by reference herein in its entirety.

What is claimed is:

1. An image forming apparatus, comprising:

image forming means for forming an image indicated by image data on an intermediate transfer body;

transfer means for transferring the image formed by the image forming means to a recording material;

pattern forming means for forming a pattern for calibration on the intermediate transfer body;

detection means for reading the pattern for calibration formed on the intermediate transfer body;

condition altering means for altering image forming conditions based on a result read by the detection means;

cleaning means for removing the pattern for calibration formed on the intermediate transfer body before performing the transfer by the transfer means; and blank identifying means for identifying a blank portion by comparing an area of the recording material and an area of the image indicated by the image data in the recording material;

wherein when images are formed continuously over a plurality of recording materials, the pattern forming means forms the pattern for calibration in an area on the intermediate transfer body that corresponds to an area obtained by adding the identified blank to a space between successive recording materials.

2. The image forming apparatus according to claim 1, wherein the cleaning means abuts the intermediate transfer body only at a position thereon at which the pattern for calibration is formed, and removes the pattern for calibration on the intermediate transfer body.

3. The image forming apparatus according to claim 1, wherein the image forming means forms an image based on data that can be obtained by superposing image data of the pattern for calibration on the image data.

4. An image forming method, comprising:

an image forming step of forming an image indicated by image data on an intermediate transfer body;

a transfer step of transferring the image formed at the image forming step to a recording material;

a pattern forming step of forming a pattern for calibration on the intermediate transfer body;

a detection step of reading the pattern for calibration formed on the intermediate transfer body;

a condition alteration step of altering image forming conditions based on a result read by the detection means;

a cleaning step of removing the pattern for calibration formed on the intermediate transfer body before performing the transfer by the transfer means; and a blank identification step of identifying a blank portion by comparing an area of the recording material and an area of the image indicated by the image data in the recording material;

wherein, when images are formed continuously over a plurality of recording materials, the pattern forming step forms the pattern for calibration in an area on the intermediate transfer body that corresponds to an area obtained by adding the identified blank to a space between the successive recording materials.

* * * * *